US007775767B2

(12) United States Patent
Takemoto et al.

(10) Patent No.: US 7,775,767 B2
(45) Date of Patent: Aug. 17, 2010

(54) FAN ASSEMBLY

(75) Inventors: Shinji Takemoto, Kyoto (JP); Katsuo Tazawa, Kyoto (JP); Kazushi Ishikawa, Kyoto (JP); Akinori Yamamoto, Kyoto (JP)

(73) Assignee: Nidec Corporation, Kyoto (JP)

( * ) Notice: Subject to any disclaimer, the term of this patent is extended or adjusted under 35 U.S.C. 154(b) by 774 days.

(21) Appl. No.: 11/677,554

(22) Filed: Feb. 21, 2007

(65) Prior Publication Data

US 2007/0196208 A1 Aug. 23, 2007

(30) Foreign Application Priority Data

Feb. 22, 2006 (JP) ..... 2006-045275

(51) Int. Cl.
*F04D 29/60* (2006.01)

(52) U.S. Cl. ..... 415/211.2; 417/423.8

(58) Field of Classification Search ..... 415/211.2, 415/220; 417/423.8; 310/60, 63; 361/695
See application file for complete search history.

(56) References Cited

U.S. PATENT DOCUMENTS 6,773,239 B2 * 8/2004 Huang et al. ..... 417/354
7,207,774 B2 * 4/2007 Kashiwazaki et al. ..... 415/206
7,300,262 B2 * 11/2007 Ku et al. ..... 417/366
7,344,358 B2 * 3/2008 Lu et al. ..... 415/211.2
7,345,884 B2 * 3/2008 Horng et al. ..... 361/719

FOREIGN PATENT DOCUMENTS

JP H07-117078 B2 12/1995

OTHER PUBLICATIONS

Nidec Corp. , "D12E(DK) Series," Fan & Blowers, Jul. 2004, pp. 49, http://web.archive.org/web/20040703114403/http://www.nidec.co.jp/english/product/fm/fm_pdflist.html, Japan.

* cited by examiner

*Primary Examiner*—Ninh H Nguyen
(74) *Attorney, Agent, or Firm*—Volentine & Whitt, PLLC

(57) ABSTRACT

A fan assembly includes a plurality of rotor vanes, a motor rotating the rotor vanes with a center axis J1 as center, a plurality of stator vanes arranged in a passage of air flow generated by rotation of the rotor vanes, and a base portion including a plate-like portion and side circumferential wall. A radially inner end of the stator vane is connected to the side circumferential wall of the base portion, and a side opening is arranged in the side circumferential wall. The air flow generated by rotation of the rotor is guided along the stator vane and taken into the motor to cool of the heat generating source arranged therein.

20 Claims, 9 Drawing Sheets

FAN ASSEMBLY

BACKGROUND OF THE INVENTION

1. Technical Field

The present invention generally relates to an electrically powered fan assembly.

2. Description of the Related Art

An electronic device generally includes a fan assembly which blows air and discharges heat generated by the electronic device. The fan assembly includes a motor rotating a plurality of rotor vanes to generate air flow. Recently, a high-end electronic device generates considerable heat, and the motor rotating rotor vanes at high speed for discharging more heat is called for.

To increase the rotational speed of the motor, drive current provided to the motor increases as well. Due to the increase of the drive current, some electronic parts of the motor (e.g., coils provided to an armature) generates considerable heat which may damage other electronic parts and degenerate a performance of the motor. To date the following mechanisms have been proposed for cooling a circuit board and coils of the motor used for the fan assembly.

In a conventional motor used for the fan assembly, a stator core and coils provided thereto are arranged at an internal space of a motor casing defined by a rotor unit and a stator unit, and a plurality of rotor vanes are arranged at outside surface of the rotor unit. When the rotor vanes rotate, negative pressure is generated at a gap defined between a stator unit and the rotor unit. Due to the negative pressure, a part of air flow generated by rotation of the rotor vanes is taken into the motor casing through the gap and then the electronic parts within the motor casing are cooled off.

Generally, the stator core and the coils are enclosed inside the motor casing. In the case, the heat generated by the stator core and the coils is accumulated within the motor casing and temperature therein considerably increases. In order to discharge the heat accumulated in the motor casing, air flow taken into the motor casing needs to be increased. In the conventional motor, however, air flow is not actively taken into the motor casing. In the conventional motor using the negative pressure to cool the electronic parts arranged thereon, the air flow taken in the motor casing is limited.

BRIEF SUMMARY OF THE INVENTION

In order to overcome the problems described above, preferred embodiments of the present invention provide a fan assembly in which air flow generated by rotation of rotor vanes is effectively taken into a space defined by a base portion and a cup-shape portion accommodating a heat generating source of the fan assembly.

A fan assembly according to the preferred embodiment of the present invention includes: a shaft arranged along a rotation axis; a cup-shaped portion secured to the shaft to rotate together with the shaft around the rotation axis in a rotational direction; a plurality of rotor vanes, supported by the cup-shaped portion, for generating air flow by rotating together with the cup-shaped portion around the rotation axis; a housing accommodating the shaft, the cup-shaped portion, and the rotor vanes therein and including a base portion opposed to the cup-shaped portion; a magnet and an armature, arranged in a space defined by the cup-shaped portion and the base portion of the housing, for generating a torque rotating the cup-shaped portion; a plurality of stator vanes arranged in a passage of the air flow to surround the base portion of the housing, each of the stator vanes having an upstream surface and a downstream surface in the rotational direction, the upstream surface guiding the air flow and being at an angle to the rotation axis with its axially upper end located upstream of its axially lower end in the rotational direction. In the fan assembly, the base portion includes a plate-like portion and a wall extending axially from the plate-like portion, and the wall is cut at two or more positions to take in a part of the air flow into the space defined by the cup-shaped portion and the base portion of the housing, the two or more positions including two positions that are approximately opposed to each other.

According to another preferred embodiment of the present invention, the base portion includes a plate-like portion and a wall extending axially from the plate-like portion. The wall is cut at one or more positions to form one or more openings for taking in a part of the air flow into the space defined by the cup-shaped portion and the base portion of the housing, each of the one or more openings including a side formed by a radially inner end of an associated one of the stator vanes.

According to yet another preferred embodiment of the present invention, the base portion includes a plate-like portion and a wall extending axially from the plate-like portion, the wall is cut at one or more positions to form one or more openings for taking in a part of the air flow into the space defined by the cup-shaped portion and the base portion of the housing, each of the one or more openings including a side crossing a radially inner end of an associated one of the stator vanes.

Through the configuration described above, the air flow is effectively taken into a motor of the fan assembly and heat accumulated in the space defined by the base portion and the cup-shaped portion is effectively discharged.

Other features, elements, processes, steps, characteristics and advantages of the present invention will become more apparent from the following detailed description of preferred embodiments of the present invention with reference to the attached drawings.

DETAILED DESCRIPTION OF THE INVENTION

First Preferred Embodiment

Figure 1:
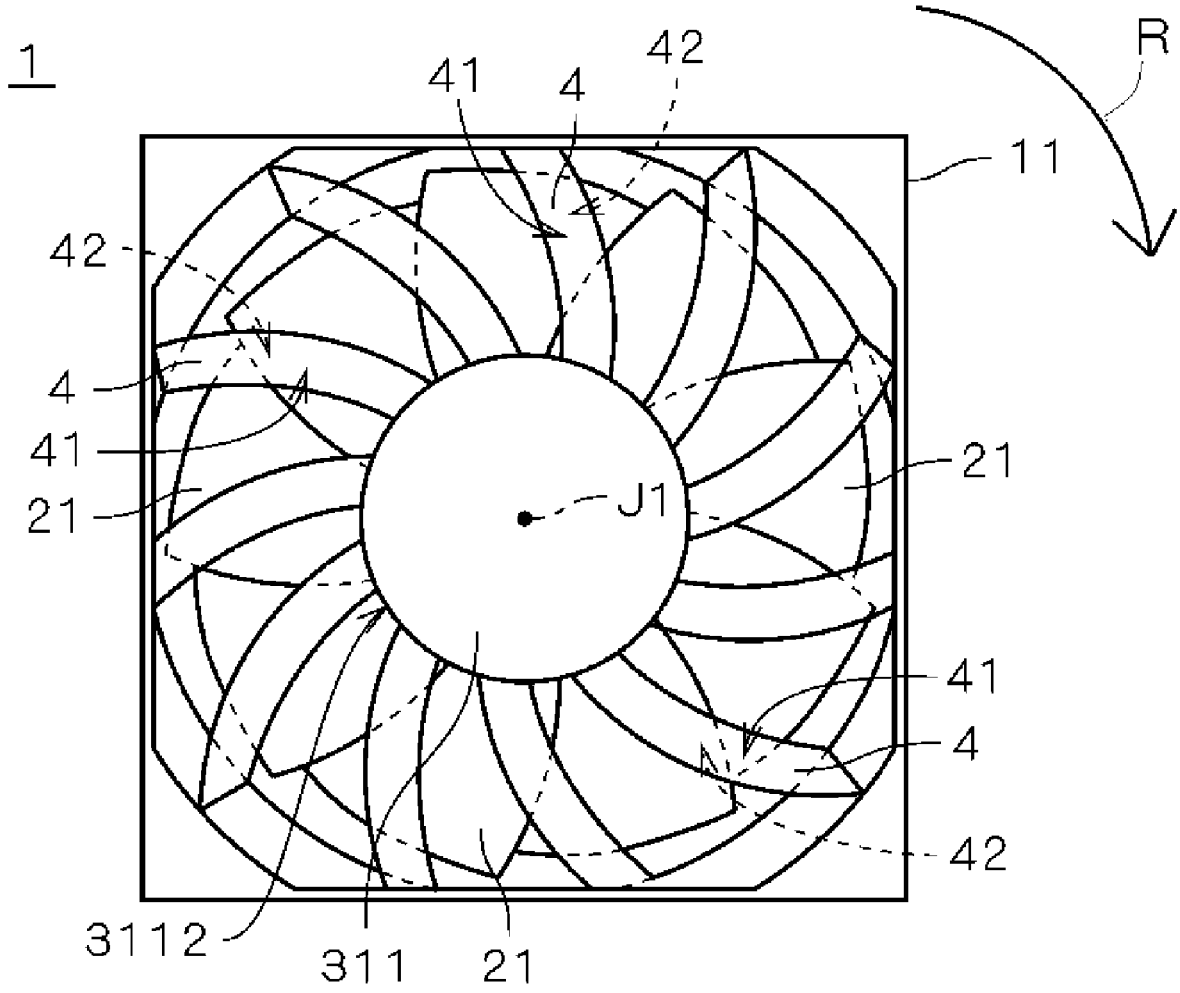
FIG. 1 is a plan view illustrating a configuration of a fan assembly according to a first preferred embodiment of the present invention.
Figure 2:
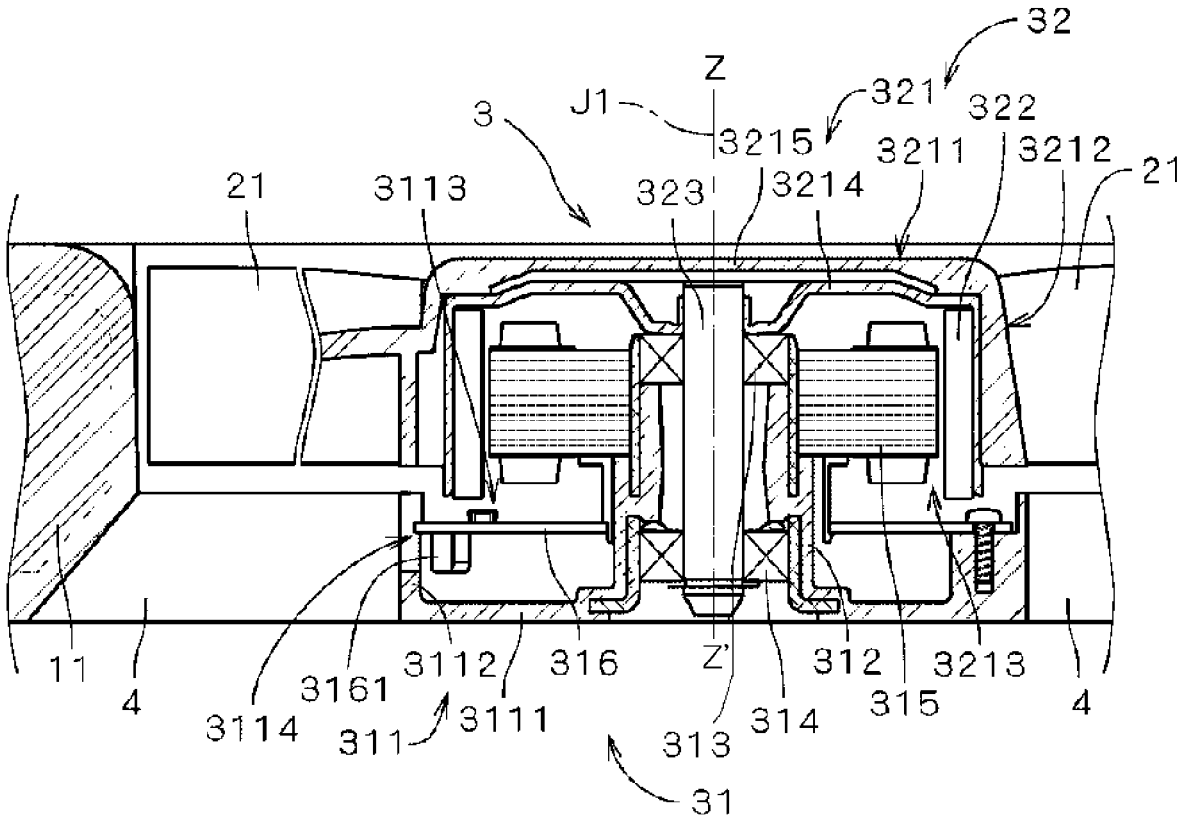
FIG. 2 a cross section view illustrating the fan assembly according to the first preferred embodiment of the present invention.

FIG. 1 is a bottom plan view illustrating a fan assembly 1 according to a first preferred embodiment of the present invention. FIG. 2 is a view illustrating a vertical section, along a plane including a center axis J1, of a portion of the fan assembly 1 according to the first preferred embodiment of the present invention. As illustrated in FIGS. 1 and 2, the fan assembly 1 includes a housing 11, a plurality of rotor vanes 21 (nine of them in the first preferred embodiment of the present invention) surrounded by the housing 11, and a plurality of stator vanes 4 (eleven of them in the first preferred embodiment of the present invention) arranged below the rotor vanes 21 in a manner fixed to the housing 11. As illustrated in FIG. 2, the fan assembly 1 includes a motor 3. The rotor vanes 21 are attached to the motor 3 so as to rotate about the center axis J1 upon the rotation of the motor 3. The fan assembly 1 is, for example, used for an air-cooling fan for an electronic device.

The motor 3 is an outer rotor type motor, including a stator unit 31 which is a stationary assembly and a rotor unit 32 which is a rotor assembly. The rotor unit 32 is supported rotatably relative to the stator unit 31 with the center axis J1 as center by a later-described bearing mechanism. For convenience in the following explanation, the rotor unit 32 side (an upper side in FIG. 2) along the center axis J1 will be described a Z side of the fan assembly 1 as illustrated in FIG. 2, and the stator unit 31 side (a bottom side in FIG. 2) as the Z' side of the fan assembly 1, but the center axis J1 need not necessarily coincide with the direction of gravity and the directions in attached drawings. In addition, a rotational direction of the rotor vanes from an upstream side to a downstream side is illustrated in the drawings by an arrow.

The stator unit 31 includes a base portion 311 having a substantially hollow, cylindrical shape with a base centered on the center axis J1. The base portion 311 is connected to the housing 11 by the plurality of stator vanes 4 and supports the various components of the stator unit 31. The base portion 311, the stator vanes 4 and the housing 11 are formed by injection molding in an integral manner with a resin material. The base portion 311 includes a bearing supporting portion 312 having a substantially hollow, cylindrical shape centered on the center axis J1. The bearing supporting portion 312 protrudes into the Z side direction (i.e., an upward direction in FIG. 2) from a plate-like portion 3111 defining a bottom of the base portion 311. Ball bearings 313 and 314, constituting the bearing mechanism, are arranged within the bearing supporting portion 312 at a Z side portion and a Z' side portion thereof respectively.

The stator unit 31 also includes an armature 315 and an annular circuit board 316. The armature 315 is arranged to a radially outside surface of the bearing supporting portion 312, inside of which supports the bearing mechanism (i.e., the armature 315 is attached to the base portion 311 at around the bearing supporting portion 312). The circuit board 316 electrically connected to the armature 315 is supported below the armature 315 in a space defined by a side circumferential wall 3112 of the base portion 311 which axially extends into a Z side direction from the plate-like portion 3111. In other words, the armature 315 is arranged above the circuit board 316 so as to axially oppose the circuit board 316. An electronic component 3161 is mounted on a Z'-side surface of the circuit board 316.

The rotor unit 32 includes a cup-shaped portion 321 which has a substantially hollow, cylindrical shape centered on the center axis J1. The cup-shaped portion 321 includes a Z'-side axial end opening 3213, while a Z-side end thereof is covered (i.e., the cup-shaped portion 321 includes a cap portion 3211). The rotor unit 32 also includes a magnet 322 attached to an radially inside of the cup-shaped portion 321 so as to oppose the armature 315, and a shaft 323 axially extending along the center axis J1 from the cap portion 3211 into Z' side direction. The cup-shaped portion 321 also includes a yoke 3214 and a rotor hub 3215. The yoke 3214 is made of magnetic metal material and has a hollow, cylindrical shape with a covered Z-side end portion. The rotor hub 3215 is made of resin material and arranged so as to cover outside the rotor yoke 3214. The cup-shaped portion 321 is arranged such that a Z'-side end opening 3213 of the cup-shaped portion 321 opposes a Z-side end opening 3113 of the base portion 311. Through the configuration, a space accommodating various components of the fan assembly (e.g., the armature 315, the circuit board 316, the electronic component 3161, and the like) therein is defined by the base portion 311 and the cup-shape portion 321.

The shaft 323 is attached to the Z-side end portion of the yoke 3214 of the cup-shaped portion 321, and then is inserted into the bearing supporting portion 312 such that the cup-shaped portion 321 and the shaft 323 are rotatably supported by the ball bearings 313 and 314. In the fan assembly 1, the shaft 323, and the ball bearings 313 and 314 define the bearing mechanism which supports the cup-shaped portion 321 in a rotatable manner about the center axis J1 in relative to the base portion 311. Then, by providing the drive current to the armature 315, torque centered on the center axis J1 is generated between the magnet 322 and the armature 315. The drive current is provided to the armature 315 via the circuit board 316. The torque rotates the cup-shaped portion 321, shaft 323, and the rotor vanes 21 radially extending from an outer side surface of the cup-shaped portion 3212 with centering on the center axis J1.

In the fan assembly 1, air is taken from the Z-side of the fan assembly 1 (i.e., the upper side in FIG. 2) and then is discharged into Z'-side of the fan assembly 1 (i.e., the bottom side in FIG. 2) by rotating the rotor vanes 2 into the rotational direction R. Since the plurality of rotor vanes 21 are attached to the motor, the rotor vanes and the motor rotate in a same direction. Thus, for convenience in the following explanation, the rotational direction of the rotor vanes will be described as a rotational direction of the motor.

As illustrated in FIG. 1, when the fan assembly is viewed from the stator-vane-4 side (i.e., from the Z' side), a Z-side-axial end of the stator vane is arranged upstream position in the rotational direction R from a Z'-side-axial end of the stator vane. A radially inner end of the stator vane is connected to the side circumferential wall 3112 of the base portion 311, and a radially outer end of the stator vane is connected to the housing 11. The stator vane 4 includes an upstream surface 41 and a downstream surface 42. The upstream surface 41 is a side surface of the stator vane 4 arranged upstream in the rotational direction R, and the downstream surface 42 is another side surface of the stator vane 4 arranged downstream in the rotational direction R. The upstream surface 41 guides air flow discharged by rotation of the rotor vanes 21 and is hereinafter referred to as an air-guide surface 41. Thus, each of the stator vanes 4 includes the air-guide surface 41 and a downstream surface 42.

Figure 3:
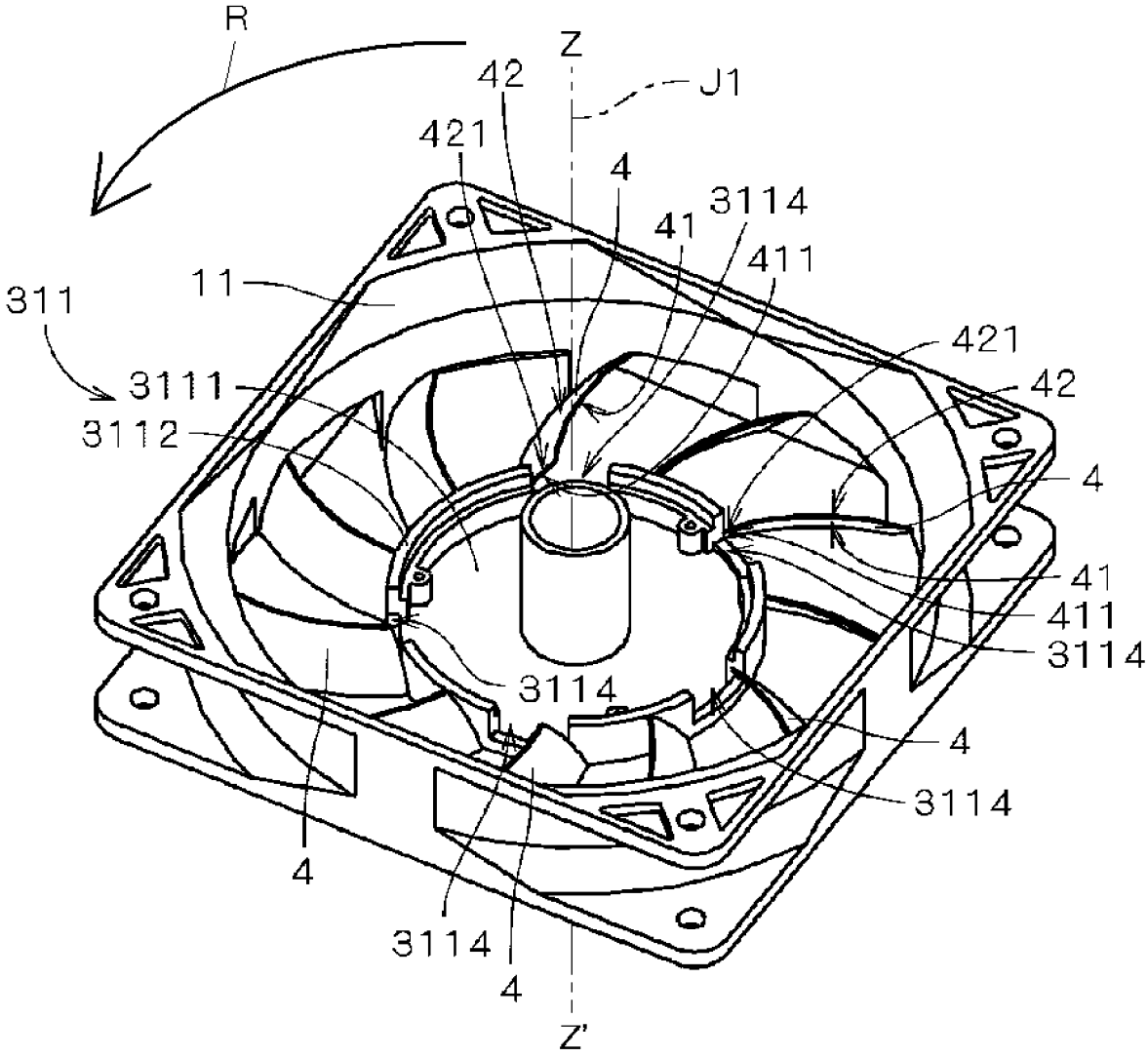
FIG. 3 is a perspective view illustrating a housing, a base portion, and a stator vane of the fan assembly according to the first preferred embodiment of the present invention.

FIG. 3 is a perspective view illustrating the housing 11, the base portion 311, and the stator vanes 4 of the fan assembly 1 according to the first preferred embodiment of the present invention. Each of the stator vanes 4 includes an air-guide-surface rim 411 which is a radially inner rim of the air-guide surface 41 and a downstream-surface rim 421 which is a radially inner rim of the downstream surface 42. As illustrated in FIG. 3, the air-guide-surface rim 411 and the downstream-surface rim 421 are at an angle to the center axis J1.

The side circumferential wall 3112 of the base portion 312 includes a side opening 3114, formed by cutting a portion of the side circumferential wall 3112 in a substantially rectangular shape at a position near the air-guide-surface rim 411 of the stator vane 4. In the first preferred embodiment of the present invention, the fan assembly 1 includes eleven stator vanes 4 and five side openings 3114 thus the side openings 3114 are arranged near the air-guide-surface rim 4111 of five stator vanes which are not adjacent each other. The number of the stator vanes 4 and the side openings 3114 provided to the fan assembly 1 may be modified. To maintain strength of the base portion 311, the number of the side opening 3114 is preferably a closest positive integer to a half of the number of the stator vanes 4. However, the number of the side openings 3114 may be increased more than the half of that of the stator vanes 4 to discharge more heat accumulated in the space defined by the base portion 311 and the cup-shaped portion 321. Moreover, at least two side openings 3114 are arranged approximately opposed to each other. Through the configuration, a part of air flow is smoothly taken to the space, and the heat is effectively discharged from the space defined by the base portion 311 and the cup-shaped portion 321.

As illustrated in FIG. 3, the side opening 3114 according to the first preferred embodiment of the present invention axially downwardly extends from an axially Z-side end of the side-circumferential wall 3112. The side opening 3114 may be formed during an injection molding process in which the base portion 311, the housing 11 and the stator vanes 4 are formed in the integral manner.

The side opening 3114 is arranged such that a part of the air-guide surface rim 411 is exposed to the side opening 3114 (i.e., the side opening 3114 includes one side the air-guide-surface rim 411 is crossing.) Similarly, a part of the downstream surface rim 421 is exposed to the side opening 3114. However, the side opening 3114 is arranged such that the air-guide surface rim 411 includes greater area which is exposed to the side opening 3114 compared with the downstream surface rim 421. The side opening 3114 extends axially toward the Z' side so as to pass an axial position where a Z'-side surface of the circuit board 316 is arranged, thus connects a space defined by the circuit board 316 and the base portion 311 to outside directly.

When the rotor vanes 21 rotate, axial air flow expanding radially outwardly is generated. Then the air flow meets the stator vanes 4 arranged in a passage of air flow and is guided toward the center axis J1 side. As a result, the air flow discharged from the fan assembly 1 may be intensively directed toward the heat generating source of the electronic device, and thus, it is possible to cool the heat generating source effectively.

Additionally, in the fan assembly 1, the air flow is guided toward the center axis J1 along the air-guide surface 41 of the stator vane 4, and a part of the air flow guided toward the center axis J1 is taken into the space defined by the base portion 311 and the cup-shaped portion 321. In the present preferred embodiment of the present invention, the side opening 3114 is arranged in the side circumferential wall 3112 of the base portion 311. Thus, the air flow is smoothly taken through the side opening 3114, and heat generated by heat generating sources arranged within the space (e.g., the circuit board 316 and the armature 315) is effectively discharged.

In the first preferred embodiment of the present invention, since more than a half area of the air-guide-surface rim 411 of the stator vane 4 is exposed to the side opening 3114, the air flow is effectively taken to the space defined by the base portion 311 and the cup-shaped portion 321. In addition, since the side opening 3114 extends axially passing the axial position where the Z'-side surface of the circuit board 316 is arranged, the circuit board 316 and the electronic component 3161 (i.e., the heat generating source provided to the circuit board 316) are effectively cooled off.

As described above, since the air is mainly taken to the space defined by the base portion 311 and the cup-shape portion 321 along the air-guide surface 41 of the stator vane 4, it is not necessary that a part of the side opening 3114 is arranged downstream in the rotational direction R of the downstream surface 42. Therefore, a part of the side opening 3114 may be defined by a part of the air-guide-surface rim 411 of the stator vane 4 (i.e., a part of the air-guide-surface rim 411 may be exposed to the space defined by the cup-shape portion 321 and the base portion 311.) Preferably, more than the half area of one air-guide-surface rim 411 defines a part of the corresponding side opening 3114. Through the configuration described above, the air flow effectively flows into the space defined by the base portion 311 and the cup-shaped portion 321 and the heat is effectively discharged as well.

Second Preferred Embodiment

Figure 4:
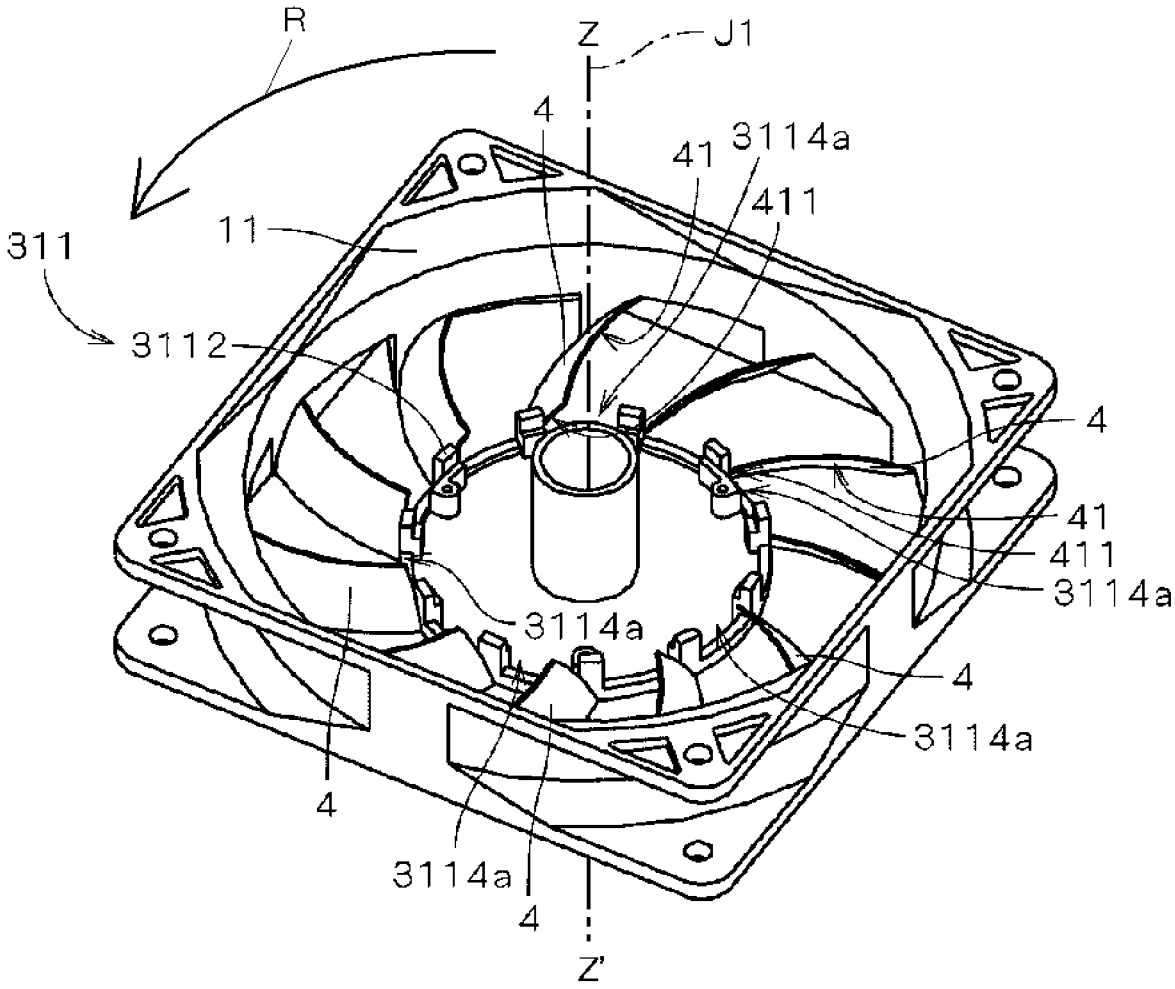
FIG. 4 is a perspective view illustrating a housing, a base, and a stator vane of a fan assembly according to a second preferred embodiment of the present invention.

Next, a fan assembly 1 according to a second preferred embodiment of the present invention will be described in detail. FIG. 4 is a perspective view illustrating the housing 11, the base portion 311, and the stator vanes 4 of a fan assembly 1 according to the second preferred embodiment of the present invention. As illustrated in FIG. 4, the fan assembly 1 according to the second preferred embodiment of the present invention includes a side opening 3114*a* having a different shape from that of the side opening 3114 illustrated in FIG. 3. The rest of the configurations are the same as those described in the first preferred embodiment of the present invention, and are labeled with the same reference numerals in the description that follows.

The fan assembly 1 according to the second preferred embodiment of the present invention includes eleven stator vanes 4 and eleven side openings 3114*a* in the side circumferential wall 3112 of the base portion 312. As described in the first preferred embodiment of the present invention, each side opening 3114*a* is arranged near the air-guide-surface rim 4111 of each of the stator vanes 4 between the neighboring stator vanes 4. Each side opening 3114 is arranged such that a part of the air-guide surface rim 411 of each stator vane 4 is exposed to the corresponding side opening 3114 (i.e., the side opening 3114 includes one side the air-guide-surface rim 411 is crossing.) In the second preferred embodiment of the present invention as well, since more than a half area of the air-guide-surface rim 411 of each stator vane 4 is exposed to the corresponding side opening 3114, the air flow is effectively taken to the space defined by the base portion 311 and the cup-shaped portion 321. Thus, the space defined by the base portion 311 and the cup-shaped portion 321 is effectively cooled off.

The fan assembly 1 according to the second preferred embodiment of the present invention includes side openings 3114*a* arranged between every neighboring stator vanes 4, thus air flow taken into the space defined by the base portion 311 and the cup-shaped portion 321 are increased. Therefore, the heat accumulated in the space defined by the base portion 311 and the cup-shaped portion 321 is effectively discharged.

Third Preferred Embodiment

Figure 5:
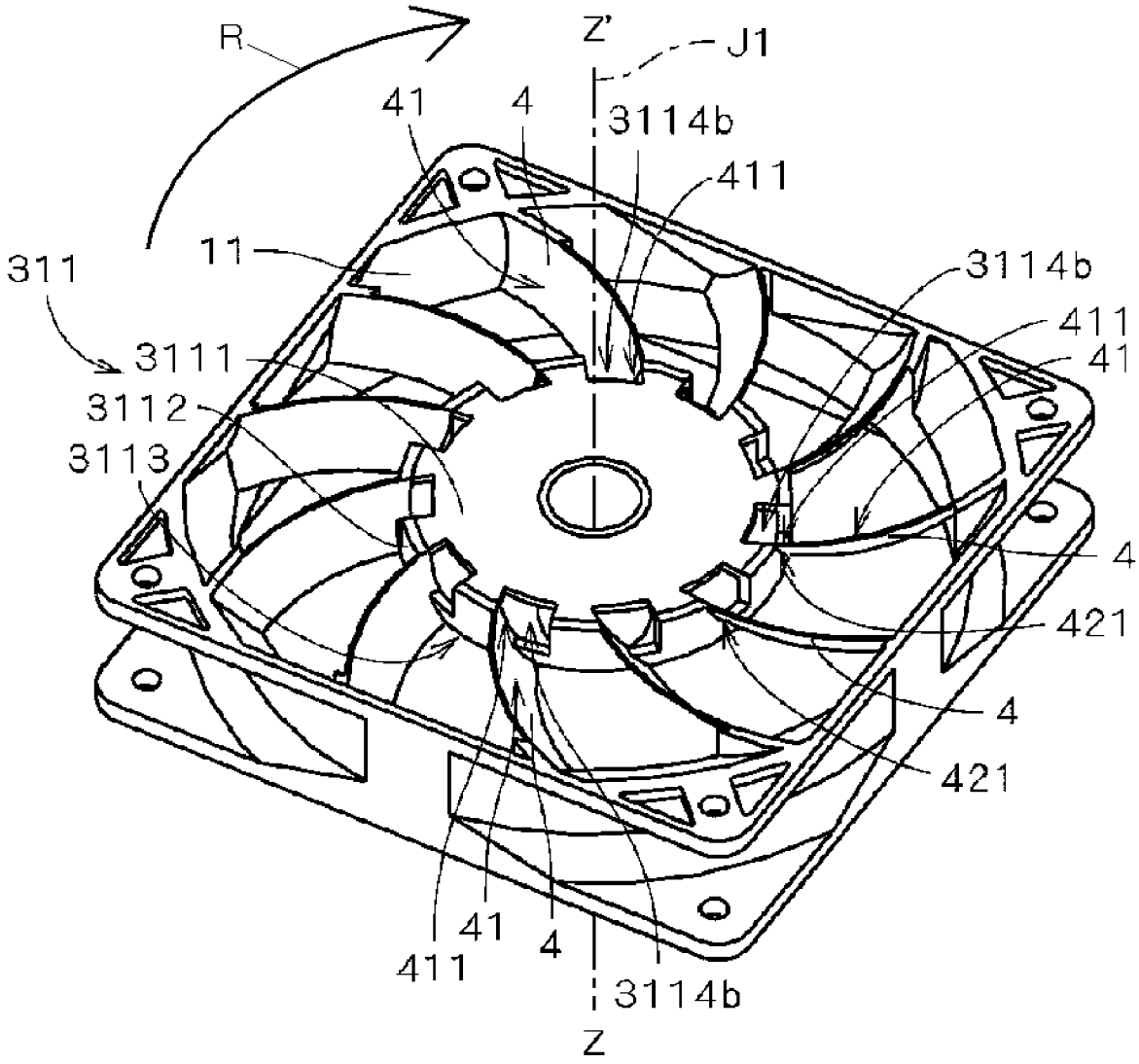
FIG. 5 is a perspective view illustrating a housing, a base, and a stator vane of a fan assembly according to a third preferred embodiment of the present invention.

Next, a fan assembly 1 according to a third preferred embodiment of the present invention will be described in detail. FIG. 5 is a perspective view illustrating the housing 11, the base portion 311, and the stator vanes 4 of a fan assembly 1 according to the third preferred embodiment of the present invention. It should be noted that the housing 11, the base portion 311, and the stator vanes 4 are viewed from the Z' side. The upside and the bottom side in FIG. 5 are reversed from those in FIGS. 3 and 4.

As illustrated in FIG. 5, the fan assembly 1 according to the third preferred embodiment of the present invention includes side openings 3114*b* extends axially in the side circumferential wall 3112 and radially in a plate-like portion 3111 of the base portion 311. In other words, a portion of the side-circumferential wall 3112 is axially cut and a portion of the plate-like portion 3111 is cut in the radial direction, such that these portions are connected to each other to constitute each of the side opening 3114*b*. The rest of the configurations are the same as those illustrated in FIGS. 1 to 3, and are labeled with the same reference numerals in the description that follows.

The fan assembly 1 according to the third preferred embodiment of the present invention includes eleven stator vanes 4 and eleven side openings 3114*b*. The side openings 3114*b* are arranged between every neighboring stator vanes 4. Each side opening 3114*b* has a shape in which a part of the side opening 3114*b* is along a part of the air-guide-surface rim 411. In other words, the side circumferential wall 3112 is cut in a manner partially along the air-guide-surface rim 4111 to provide the side opening 3114*b*. In the third preferred embodiment of the present invention, the side opening 3114*b* is formed in a manner being along more than the half area of the air-guide-surface rim 411 of the stator vane 4.

Each side opening 3114*b* extend axially toward the plate-like portion 3111 of the base portion 311, and a width of each side opening 3114*b* in the circumferential direction centered on the center axis J1 grows gradually larger toward the plate-like portion 3111 of the base portion 311. The side opening 3114*b* extends in the plate-like portion 3111 of the base portion 311 into a radially inward direction. A length which the side opening 3114*b* extends radially inwardly is greater than the thickness of the side circumferential wall 3112 of the base portion 311.

The base portion 311, the stator vanes 4 and the housing 11 are formed by injection molding in an integral manner with a resin material, and the side opening 3114*b* may be formed during the injection molding process concurrently.

Through the configuration described above, a part of the air flow is guided into the space defined the cup-shaped portion 321 and the base portion 311 through the side opening 3114*b* along the air-guide surface 41 of the stator vane 4. Moreover, by exposing more than half area of the air-guide-surface rim 411 of the stator vane 4 to the space defined by the cup-shaped portion 321 and the base portion 311, the air flow is effectively taken into the space defined the base portion 311 and the cup-shaped portion 321. In addition, in the third preferred embodiment of the present invention, since a part of the plate-like portion 3111 is cut, the air flow is effectively taken to the space defined by the base portion 311 and the cup-shape portion 321, and the electronic component 3161 arranged on the Z'-side surface of the circuit board 316 (i.e., the heat generating source provided to the circuit board 316), is cooled off effectively. To cool off the electronic component 3161 arranged on the bottom surface of the circuit board 316 intensively, the side opening 3114*b* extends into radially inward direction in the plate-like portion 3111 such that a part of the circuit board 316 is directly exposed to axially outside space of the base portion 311. In the third preferred embodiment of the present invention, an entire axial length of the air-guide-surface rim 411 are connected to the side circumferential wall 3112, thus joint strength of the stator vanes 4 and the base portion 311 is preferably maintained. Moreover, cutting a part of the plate-like portion 3111, an opening area of the side opening 3114*b* becomes greater. Thus, the air flow is taken into the space defined by the base portion 311 and the cup-shaped portion 321 effectively.

Meanwhile, in the third preferred embodiment of the present invention, one side of the side opening 3111*b* is defined by the portion of the air-guide-surface rim 4111, and the entire area of downstream surface rim 4211 is connected to the side circumferential wall (i.e., the axially bottom end of the air-guide-surface rim 4111 corresponds to the axially bottom edge defining the side opening 3114*b*). Through the configuration mentioned above, the die used for the injection molding of the housing 11, the base portion 311, and the stator vanes 4 may be easily detached in the axial direction upon manufacturing the fan assembly 1.

Fourth Preferred Embodiment

Figure 6:
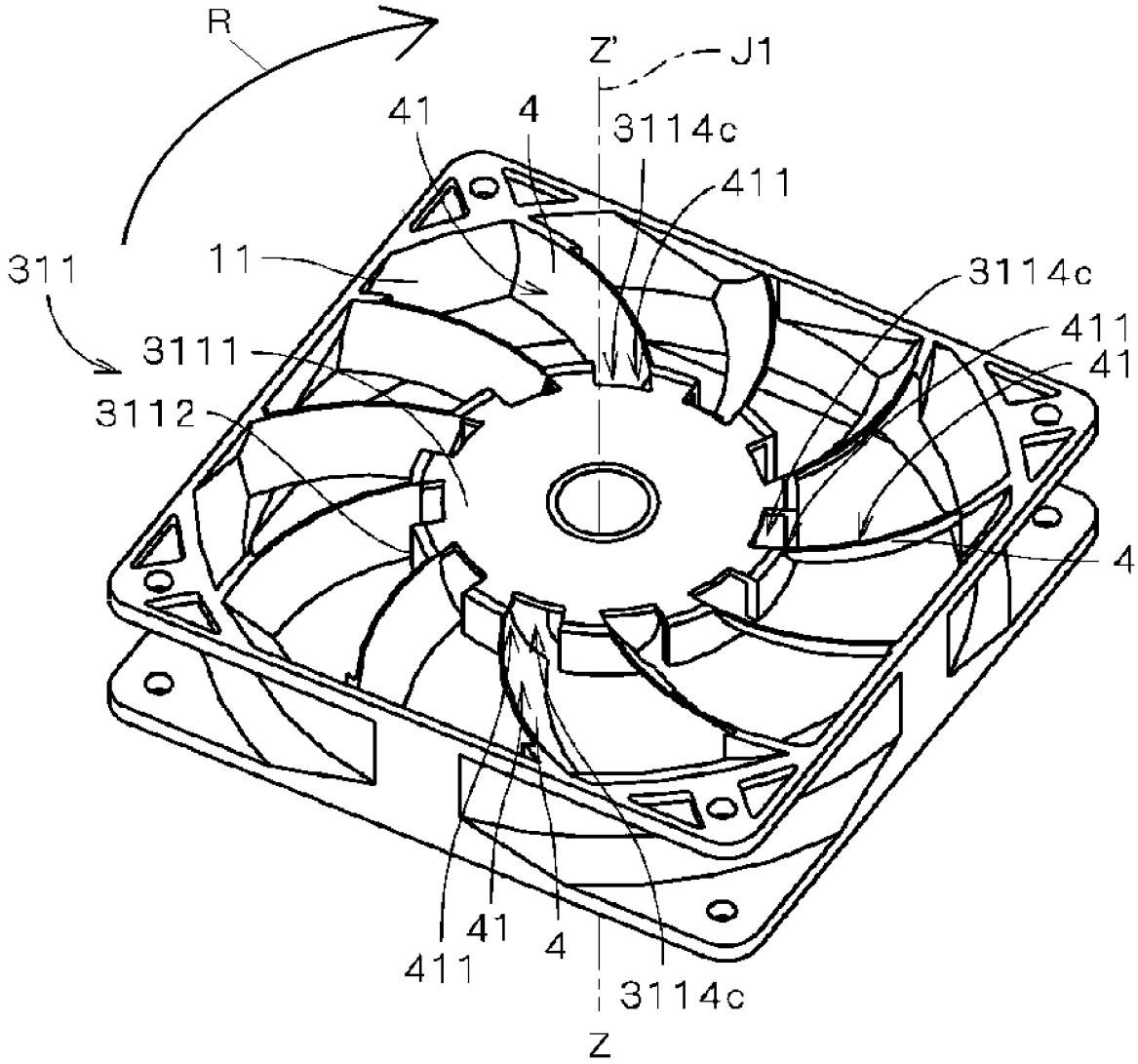
FIG. 6 is a perspective view illustrating a housing, a base, and a stator vane of a fan assembly according to a fourth preferred embodiment of the present invention.

Next, a fan assembly 1 according to a fourth preferred embodiment of the present invention will be described in detail. FIG. 6 is a perspective view illustrating the housing 11, the base portion 311, and the stator vane 4 of a fan assembly 1 according to the fourth preferred embodiment of the present invention. It should be noted that the housing 11, the base portion 311, and the stator vanes 4 are viewed from the Z' side. The upside and the bottom side in FIG. 5 are reversed from those in FIGS. 3 and 4.

As illustrated in FIG. 6, the fan assembly 1 according to the fourth preferred embodiment of the present invention includes a side opening 3114*c* having a different shape from the side opening 3114*b* described above. The rest of the configurations are the same as those illustrated in FIG. 5, and are labeled with the same reference numerals in the explanation that follows.

In the fourth preferred embodiment of the present invention, each of the side openings 3114*c* extends in the side circumferential wall 3112 over the entire axial length thereof. The plate-like portion 3111 is cut at a portion corresponding to each of the side openings 3114*c* and connected thereto. An entire length of the air-guide-surface rim 411 defines one side of the side opening 3114*c*. Thus, entire length of the air-guide-surface rim 411 is exposed to the space defined by the base portion 311 and the cup-shaped portion 321. The air flow is effectively taken into the space defined by the base portion 311 and the cup-shaped portion 321.

Fifth Preferred Embodiment

Figure 7:
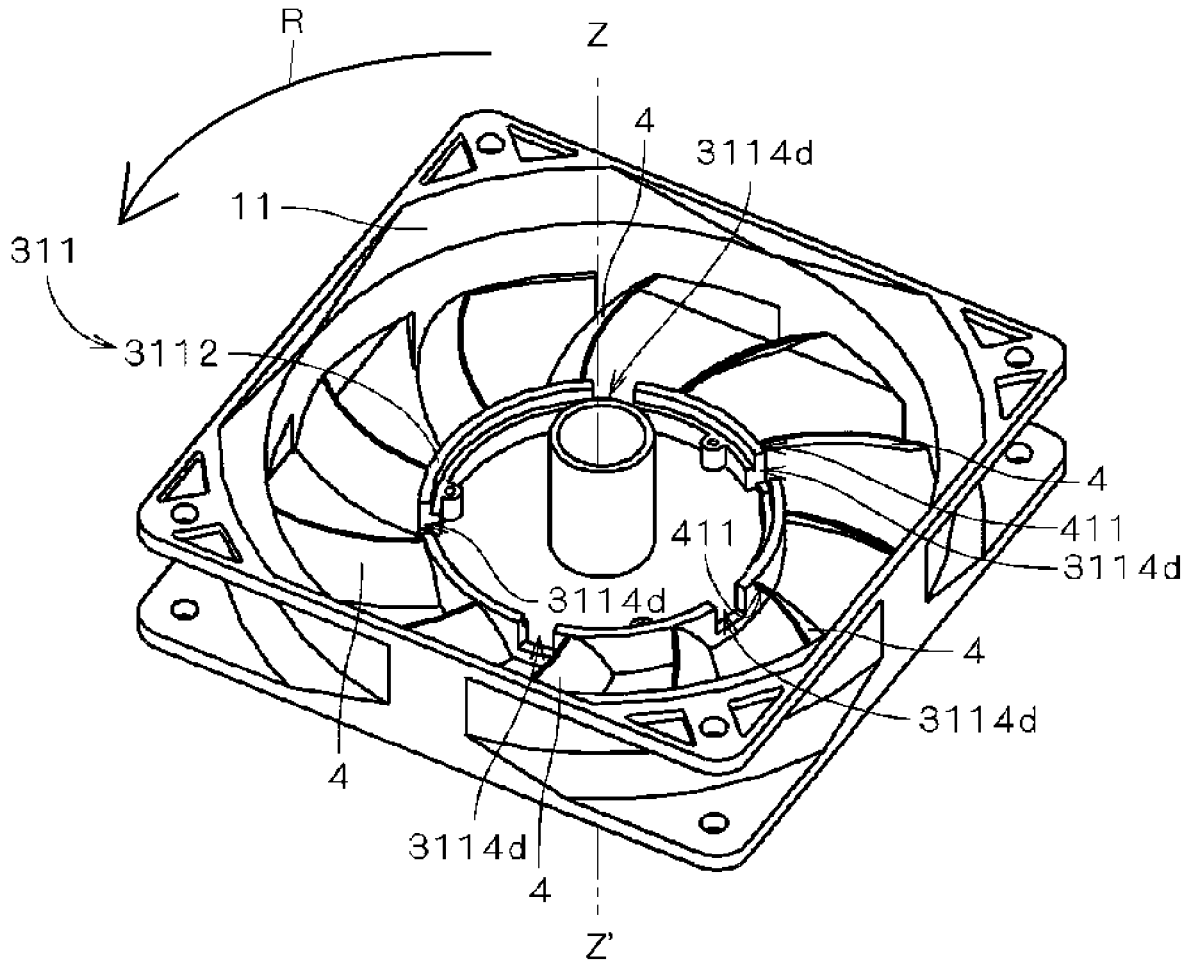
FIG. 7 is a perspective view illustrating a housing, a base, and a stator vane of a fan assembly according to a fifth preferred embodiment of the present invention.

Next, a fan assembly 1 according to a fifth preferred embodiment of the present invention will be described in detail. FIG. 7 is a perspective view illustrating the housing 11, the base portion 311, and the stator vanes 4 of a fan assembly 1 according to the fifth preferred embodiment of the present invention. As illustrated in FIG. 7, the fan assembly 1 according to the fifth preferred embodiment of the present invention includes a side opening 3114*d*, arranged in the side circumferential wall 3112 of the base portion 311, having a different shape from the side opening 3114 illustrated in FIG. 3. The rest of the configurations are the same as those illustrated in FIGS. 1 to 3, and are labeled with the same reference numerals in the description that follows.

In the fifth preferred embodiment of the present invention, the side opening 3114*d* is arranged circumferentially between the neighboring stator vanes 4. In the fifth preferred embodiment of the present invention, the axially entire length of the air-guide-surface rim 4111 and the downstream-surface rim 4211 is connected to the side-circumferential wall 3112. The number of the stator vanes 4 and the side openings 3114 provided to the fan assembly 1 may be modified. To maintain strength of the base portion 311, the number of the side opening 3114*d* is preferably a closest positive integer to a half of the number of the stator vanes 4. However, the number of the side openings 3114*d* may be increased more than the half of that of the stator vanes 4 to discharge more heat accumulated in the space defined by the base portion 311 and the cup-shaped portion 321. Meanwhile, at least two side openings 3114*d* are arranged approximately opposed to each other. Through the configuration, a part of air flow is smoothly taken to the space, and the heat is effectively discharged from the space defined by the base portion 311 and the cup-shaped portion 321.

Sixth Preferred Embodiment

Figure 8:
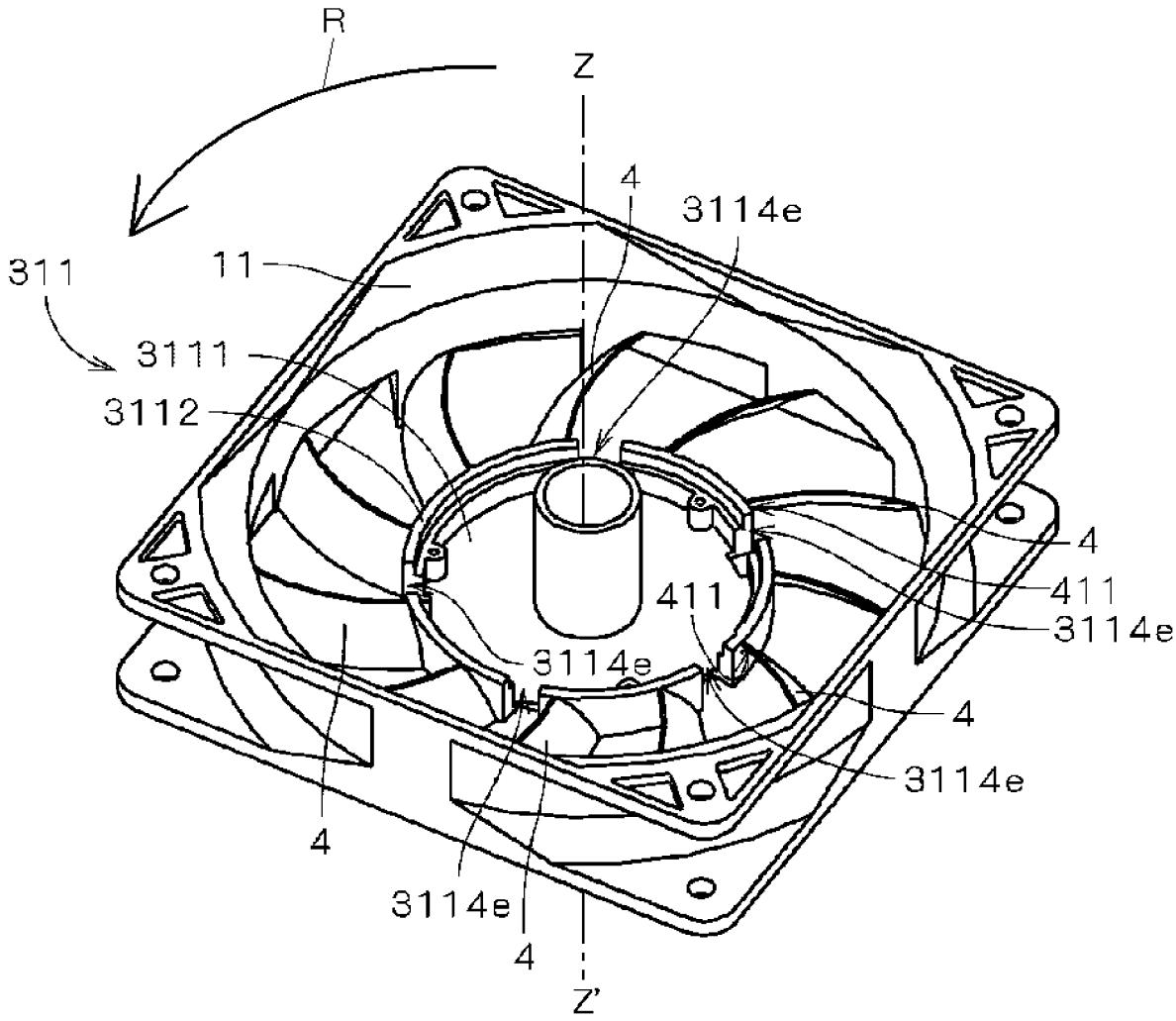
FIG. 8 is a perspective view illustrating a housing, a base, and a stator vane of a fan assembly according to a sixth preferred embodiment of the present invention.

Next, a fan assembly 1 according to a sixth preferred embodiment of the present invention will be described in detail. FIG. 8 is a perspective view illustrating the housing 11, the base portion 311, and the stator vane 4 of a fan assembly 1 according to the sixth preferred embodiment of the present invention. As illustrated in FIG. 8, the fan assembly 1 according to the sixth preferred embodiment of the present invention includes a side opening 3114*e*, arranged in the side circumferential wall 3112 of the base portion 311, having a different shape from the side opening 3114*d* illustrated in FIG. 7. The rest of the configuration is the same as that of FIG. 7, and is labeled with the same reference numerals in the explanation that follows.

In the sixth preferred embodiment of the present invention, the side opening 3114*e* is arranged circumferentially between the neighboring stator vanes 4. The axially entire length of the air-guide-surface rim 4111 and the downstream-surface rim 4211 is connected to the side-circumferential wall 3112. Additionally the side opening 3114*e* extends the entire axial length of the base portion 311. The number of the stator vanes 4 and the side openings 3114*e* provided to the fan assembly 1 may be modified. To maintain strength of the base portion 311, the number of the side opening 3114*e* is preferably a closest positive integer to a half of the number of the stator vanes 4. However, the number of the side openings 3114*e* may be increased more than the half of that of the stator vanes 4 to discharge more heat accumulated in the space defined by the base portion 311 and the cup-shaped portion 321. Meanwhile, at least two side openings 3114*e* are arranged approximately opposed to each other. Through the configuration, a part of air flow is smoothly taken to the space, and the heat is effectively discharged from the space defined by the base portion 311 and the cup-shaped portion 321.

While embodiments of the present invention have been described in the foregoing, the present invention is not limited to the embodiments detailed above, in that various modifications are possible.

Figure 9:
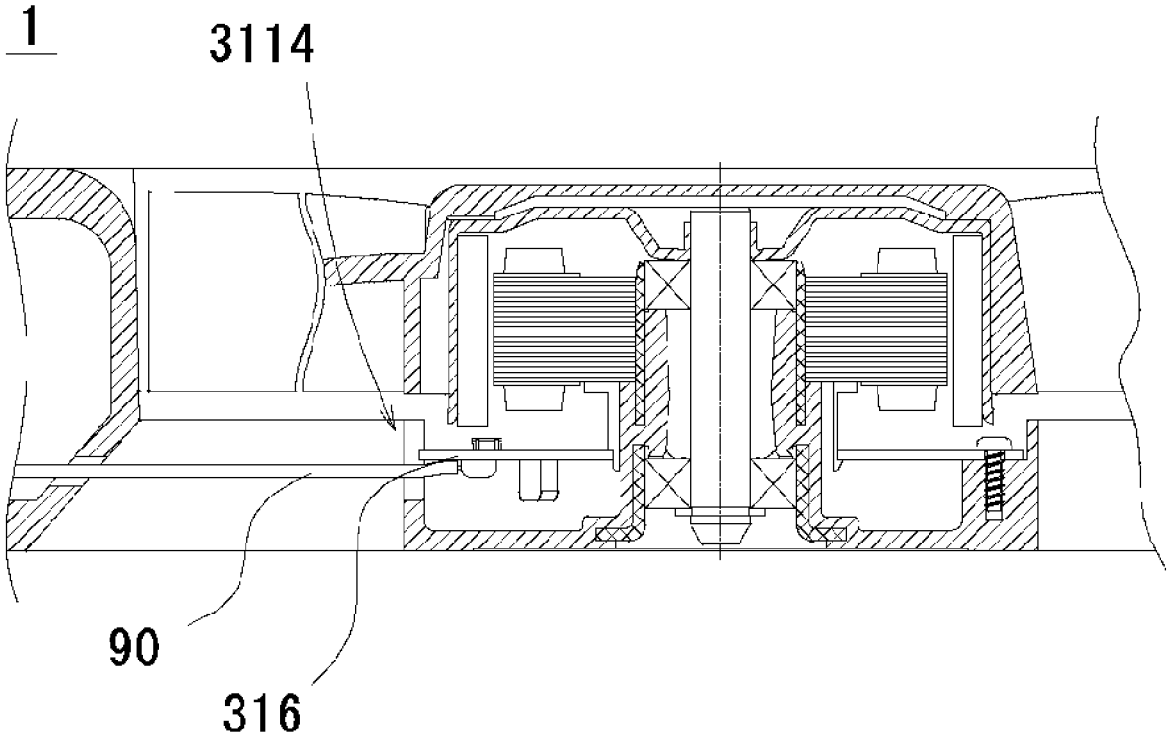
FIG. 9 is a cross sectional view of a fan assembly according to a preferred embodiment of the present invention.

As illustrated in FIG. 9, a lead wire 90 connecting the circuit board 316 and an external power supply, for example, may be extracted through one of the side openings 3114.

The electronic component 3161 may be arranged both sides of the circuit board 316. In this case, the side opening may be protrudes in the side circumferential wall of the base portion axially both direction from the circuit board 316.

Meanwhile, a portion of the circuit board 316 may be arranged outside of the base portion 311. In this case, a second circuit board arranged outside of the base portion 311 is electrically connected to the circuit board 316 arranged within the base portion 311 by a flexible circuit board, a lead wire, a wire, and the like. Likewise the example illustrated in FIG. 9, the flexible circuit board, the lead wire, the wire, and the like may extend through one of the side openings.

The number of the rotor vanes 21 and the stator vanes 4 provided to the fan assembly 1 may be varied based on a variety of the conditions, such as conditions of use, specifications called for, and the like.

Angles of the gradient of the air-guide surface 411 and the downstream surface 421 relative to the center axis J1 are not limited to those described in drawings, the angle may be varied based on a variety of the conditions, such as numbers of the stator vanes 4 and/or rotor vanes 21, rotational speed of the rotor vanes 21, and the like. Meanwhile, the air-guide surface 411 and the downstream surface 421 may be arranged in a manner parallel to the center axis J1.

To those skilled in the art, however, it will be apparent from the foregoing disclosure that various changes and modifications can be made herein without departing from the scope of the invention as defined in the appended claims.

What is claimed is:

1. A fan assembly comprising:

a shaft supported in the assembly so as to be rotatable about an axis extending in an axial direction of the assembly;

a cup-shaped portion integral with the shaft so as to rotate together with the shaft around the axis;

a plurality of rotor vanes, supported by the cup-shaped portion, for generating air flow by rotating together with the cup-shaped portion around the axis;

a housing accommodating the shaft, the cup-shaped portion, and the rotor vanes therein;

a base portion opposed to the cup-shaped portion;

a magnet and an armature, arranged in a space defined by the cup-shaped portion and the base portion, for generating a torque that rotates the shaft and the cup-shaped portion in a direction of rotation about the axis; and a plurality of stator vanes arranged in a passage of the air flow about the base portion, each of the stator vanes extending between and connecting the base portion and the housing, each of the stator vanes having an upstream surface and a downstream surface in the direction of rotation, the upstream surface having axially upper and lower edges with the upper edge being disposed closer to the rotor vanes in the axial direction than the lower edge, and the upper edge being located upstream of the lower edge in the direction of rotation, wherein the upstream surface is skewed relative to vertical when vertical is in the axial direction, wherein:

the base portion includes a plate-like portion and a wall extending in the axial direction from the plate-like portion, and the wall has two or more side openings extending therethrough in a radial direction perpendicular to the axial direction to allow part of the air flow into a space within and delimited by the cup-shaped portion and the base portion, two of the two or more side openings being located approximately across the plate-like portion of the base portion from each other, wherein a portion of a surface of at least one of the stator vanes is exposed to a side opening among the two or more side openings.

2. The fan assembly according to claim 1, wherein one each of the two or more side openings is arranged between two of the stator vanes adjacent one another in the direction of rotation.

3. The fan assembly according to claim 1, wherein the upstream surface of each of the stator vanes has a radially inner edge extending from the upper edge to the lower edge thereof, and the radially inner edge of the upstream surface each of the stator vanes is in contact over its entirety with the wall of the base portion and is spaced in its entirety from the side openings in the wall.

4. The fan assembly according to claim 1, wherein the upstream surface of each of the stator vanes has a radially inner edge extending from the upper edge to the lower edge thereof, and a part of the radially inner edge of the upstream surface of each of the stator vanes is in contact with the wall of the base portion, and a remaining part of the radially inner edge is exposed to one of the side openings and via the side opening to the space defined by the cup-shaped portion and the base portion of the housing.

5. The fan assembly according to claim 1, wherein the upstream surface of each of the stator vanes has a radially inner edge extending from the upper edge to the lower edge thereof, and a part of the radially inner edge of the upstream surface of each of the stator vanes delimits a side of an associated one of the side openings in the wall.

6. The fan assembly according to claim 5, wherein the plate-like portion of the base portion has two or more openings extending therethrough in the axial direction and contiguous with the side openings in the wall, respectively.

7. The fan assembly according to claim 1, wherein each of the two or more side openings extends over the entire axial length of the wall.

8. The fan assembly according to claim 1, wherein the stator vanes, the base portion, and the housing including the plate-like portion and the wall are unitary and of synthetic resin.

9. A fan assembly comprising:

a shaft supported in the assembly so as to be rotatable about an axis extending in an axial direction of the assembly;

a cup-shaped portion integral with the shaft so as to rotate together with the shaft around the axis;

a plurality of rotor vanes, supported by the cup-shaped portion, for generating air flow by rotating together with the cup-shaped portion around the axis;

a housing accommodating the shaft, the cup-shaped portion, and the rotor vanes therein;

a base portion opposed to the cup-shaped portion;

a magnet and an armature, arranged in a space defined by the cup-shaped portion and the base portion, for generating a torque that rotates the shaft and the cup-shaped portion in a direction of rotation about the axis; and a plurality of stator vanes arranged in a passage of the air flow about the base portion, each of the stator vanes extending between and connecting the base portion and the housing, each of the stator vanes having an upstream surface and a downstream surface in the direction of rotation, the upstream surface having axially upper and lower edges with the upper edge being disposed closer to the rotor vanes in the axial direction than the lower edge, and the upper edge being located upstream of the lower edge in the direction of rotation, wherein the upstream surface is skewed relative to vertical when vertical is in the axial direction, wherein:

the base portion includes a plate-like portion and a wall extending in the axial direction from the plate-like portion, the wall has one or more side openings extending therethrough in a radial direction perpendicular to the axial direction to allow part of the air flow into a space within and delimited by the cup-shaped portion and the base portion, and the upstream surface of each of the stator vanes has a radially inner edge extending from the upper edge to the lower edge thereof, and a respective one of the radially inner edges delimiting one side of each of the one or more side openings in the wall.

10. The fan assembly according to claim 9, wherein the number of side openings in the wall is the closest positive integer to half the number of the plurality of stator vanes.

11. The fan assembly according to claim 9, wherein the number of side openings in the wall is larger than half the number of the plurality of stator vanes.

12. The fan assembly according to claim 9, wherein the stator vanes, the base portion, and the housing including the plate-like portion and the wall are unitary and of synthetic resin.

13. The fan assembly according to claim 9, wherein the one or more side openings in the wall include a plurality of side openings, and further comprising at least one of a lead wire and an electronic component extending through one of the side openings, and another of the side openings being completely unoccupied.

14. The fan assembly according to claim 9, wherein each of the one or more side openings extends over the entire axial length of the wall.

15. A fan assembly comprising:

a shaft supported in the assembly so as to be rotatable about an axis extending in an axial direction of the assembly;

a cup-shaped portion integral with the shaft so as to rotate together with the shaft around the axis;

a plurality of rotor vanes, supported by the cup-shaped portion, for generating air flow by rotating together with the cup-shaped portion around the axis;

a housing accommodating the shaft, the cup-shaped portion, and the rotor vanes therein;

a base portion opposed to the cup-shaped portion;

a magnet and an armature, arranged in a space defined by the cup-shaped portion and the base portion, for generating a torque that rotates the shaft and the cup-shaped portion in a direction of rotation about the axis; and a plurality of stator vanes arranged in a passage of the air flow about the base portion, each of the stator vanes extending between and connecting the base portion and the housing, each of the stator vanes having an upstream surface and a downstream surface in the direction of rotation, the upstream surface having axially upper and lower edges with the upper edge being disposed closer to the rotor vanes in the axial direction than the lower edge, and the upper edge being located upstream of the lower edge in the direction of rotation, wherein the upstream surface is skewed relative to vertical when vertical is in the axial direction, wherein:

the base portion includes a plate-like portion and a wall extending in the axial direction from the plate-like portion, the wall has one or more side openings extending therethrough in a radial direction perpendicular to the axial direction to allow part of the air flow into a space within and delimited by the cup-shaped portion and the base portion, and each of the stator vanes has a radially inner end extending from the upper edge to the lower edge of the vane between the upstream and downstream surfaces thereof, one side of each of the one or more side openings and the radially inner end of an associated one of the stator vanes crossing one another at an angle.

16. The fan assembly according to claim 15, wherein the number of side openings in the wall is the closest positive integer to half the number of the plurality of stator vanes.

17. The fan assembly according to claim 15, wherein the number of side openings in the wall is larger than half the number of the plurality of stator vanes.

18. The fan assembly according to claim 15, wherein the stator vanes, the base portion, and the housing including the plate-like portion and the wall are unitary and of synthetic resin.

19. The fan assembly according to claim 15, wherein the one or more side openings in the wall include a plurality of side openings, and further comprising at least one of a lead wire and an electronic component extending through one of the side openings, and another of the side openings being completely unoccupied.

20. The fan assembly according to claim 15, wherein each of the one or more side openings extends over the entire axial length of the wall.

* * * * *